US006382853B2

(12) United States Patent
Sawano et al.

(10) Patent No.: US 6,382,853 B2
(45) **Date of Patent: *May 7, 2002**

(54) METHOD OF PREVENTING DUST FROM ADHERING TO INK RIBBON OF PRINTER AND PRINTER

(75) Inventors: Mitsuru Sawano, Shizuoka; Hisao Ooishi, Kanagawa; Osamu Shimizu, Shizuoka, all of (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,912

(22) Filed: Jun. 3, 1999

(30) Foreign Application Priority Data

Jun. 4, 1998 (JP) ..... 10-156186

(51) Int. Cl.[7] ..... B41J 33/40
(52) U.S. Cl. ..... 400/218; 400/223; 400/244
(58) Field of Search ..... 400/218, 219, 400/221, 223, 230, 242, 244; 347/215, 217

(56) References Cited

U.S. PATENT DOCUMENTS 4,869,607 A * 9/1989 McAdams ..... 400/222
4,924,240 A * 5/1990 Herbert et al. ..... 346/1.1
4,990,007 A * 2/1991 Schmidt et al. ..... 400/218 X
5,143,461 A * 9/1992 Inoue et al. ..... 400/223 X
5,344,244 A * 9/1994 Fukahori et al. ..... 400/219 X
5,664,895 A * 9/1997 Asai et al. ..... 400/248.1
5,911,528 A * 6/1999 Song ..... 400/223
5,987,224 A * 11/1999 Koakutsu et al. ..... 395/111

FOREIGN PATENT DOCUMENTS

EP 785082 * 7/1997 ..... B41J/17/12
JP 2-136276 * 5/1990 ..... B41J/33/36
JP 3-126574 * 5/1991 ..... B41J/33/36
JP 4-185474 * 7/1992 ..... B41J/33/38
JP 7-276735 * 10/1995 ..... B41J/25/304

* cited by examiner

*Primary Examiner*—Andrew H. Hirshfeld
*Assistant Examiner*—Minh H. Chau
(74) *Attorney, Agent, or Firm*—Sughrue Mion, PLLC

(57) ABSTRACT

A thermal printer free of the unevenness of an image is devised so that dust is prevented from adhering to an ink ribbon. In the thermal printer for generating a color image on a recording material by a thermal head and others using an ink ribbon, the ink ribbon is automatically rewound by a length within one image plane and kept on standby after printing is finished and at the time of next printing, the ink ribbon is automatically let out by the length formerly rewound and gets ready for printing.

11 Claims, 8 Drawing Sheets

METHOD OF PREVENTING DUST FROM ADHERING TO INK RIBBON OF PRINTER AND PRINTER

BACKGROUND OF THE INVENTION

1. Field of the Invention

The present invention relates to a printer for generating a color image on recording material by a thermal head or a laser head using an ink ribbon, and particularly relates to a method of preventing dust from adhering to an ink ribbon and a printer.

2. Description of the Related Art

In a printer for recording an image and data by a thermal head, a laser head and others, dust adhering to recording material and others may have a serious effect upon the quality of a finished image, particularly a finished color image.

For example, as shown in FIG. 9, in a printer adopting a method of bonding a toner sheet T and an image receiving sheet R, heating them using a laser head and transferring an image generated by peeling developing from the toner sheet T to the image receiving sheet R, if dust X exists on the toner sheet T, the energy of a laser beam L for recording is attenuated or intercepted, a part in which the dust X exists is not recorded, a white dot is made, an image is thinned, the density is deteriorated and the unevenness of an image is caused.

Also, as shown in FIG. 10, in a printer adopting a method of bonding a toner sheet T and an image receiving sheet R, heating them using a thermal head TH and transferring an image generated by peeling developing from the toner sheet T to the image receiving sheet R, if dust X exists on the toner sheet T, the transmitted quantity of thermal energy from the thermal head TH to a record medium (T and R) is attenuated or intercepted in a part in which the dust X exists, the part is not recorded, a white dot or a white stripe is made, an image is thinned, the density is deteriorated and the unevenness of an image is caused.

An arrow C shows a direction in which the toner sheet T and the image receiving sheet R are moved for the thermal head.

Heretofore, to remove dust which adheres to a toner sheet and causes the above problems, an adhesive roller is arranged between the toner sheet and a laser head or a thermal head and the dust on the toner sheet has been removed by the adhesive roller.

Hereby, the dust on the toner sheet can be removed by the adhesive roller to some extent before the above laser head or thermal head. However, if a toner sheet is electrified for any reason or dust itself is electrified, it is difficult to completely remove the dust even if the adhesive roller is used. There is a problem that the provision of the adhesive roller results in the increase of the cost of a device and it troubles an operator to keep the adhesive roller a satisfactory state.

SUMMARY OF THE INVENTION

The object of the present invention is to basically solve the above problems in prior art and to provide a method of preventing dust from adhering to a toner sheet and such a printer.

To achieve the above object, in this invention, the following part of an ink ribbon is rewound in a direction in which the ribbon is let out so that dust is prevented from adhering to a part used for next printing of the ink ribbon after setting of the ink ribbon and/or every termination of printing.

In this invention, if an ink ribbon is rewound after setting the ink ribbon, the ink ribbon which has no room to be rewound is kept as it is and the ink ribbon is idly let out to the next printing start position when first printing is started.

Further, in this invention, means for automatically rewinding the ink ribbon by a predetermined length after setting the ink ribbon and/or every termination of printing is provided.

In this invention, the above predetermined length is equivalent to the length of one image plane or shorter.

Further, in this invention, means for automatically letting out an ink ribbon by a length which was rewound formerly when the next printing is started, is provided.

As described above, in this invention, as the part actually to be used is separated from a carrier, in which dust readily adheres, until an ink ribbon is used, the probability of adhering dust to the part actually to be used becomes lower. Hereby, the unevenness of an image and the deterioration of the quality of an image, which are respectively caused by a thinned image, the lower density and others, can be prevented without increasing the cost of the device and without troubling an operator.

DESCRIPTION OF THE PREFERRED EMBODIMENTS

Figure 1:
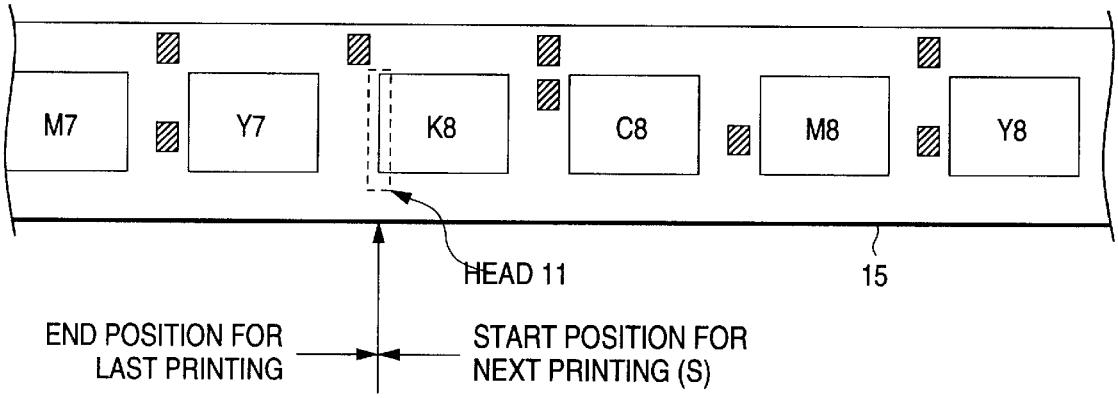
FIGS. 1(*a*)–1(*c*) are plans showing the movement of a ribbon equivalent to a first embodiment of the present invention in a thermal printer.
Figure 1:
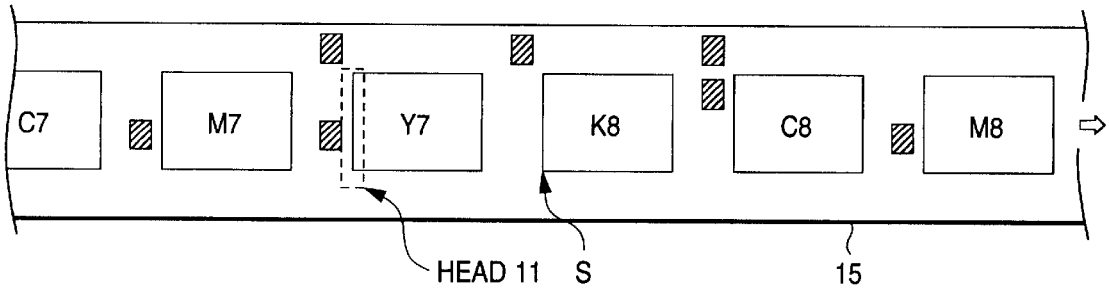
Figure 1:
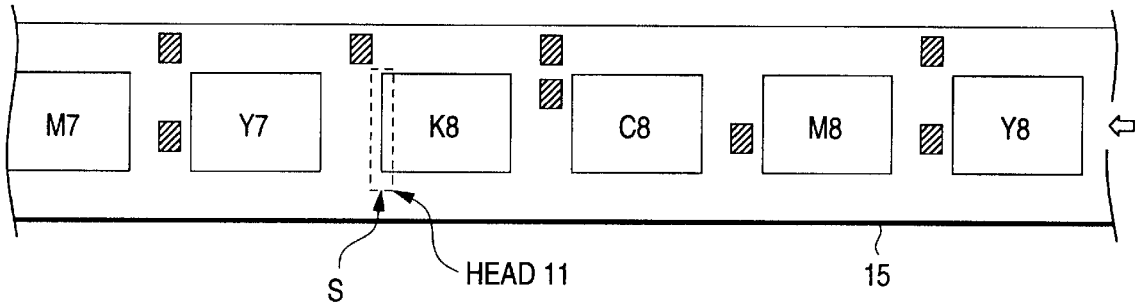

Referring to the drawings, embodiments of the present invention will be described below.

Figure 11:
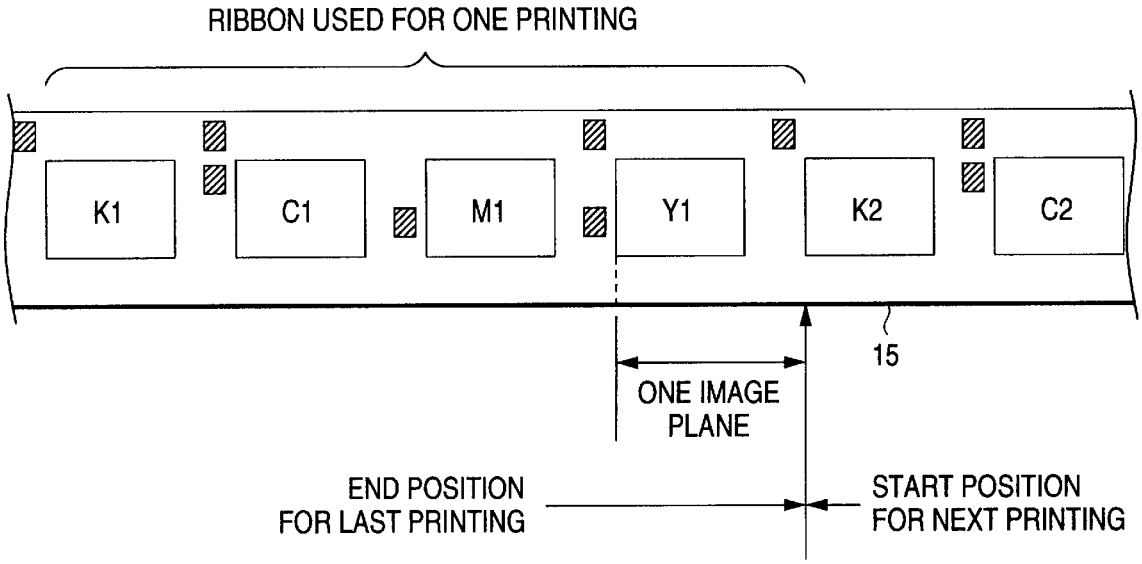
FIG. 11 is a plan showing the ribbons of K, C, M and Y used for the thermal printer.

FIG. 11 shows the configuration of a multicolor ink ribbon 15 (a so-called striped ribbon, hereinafter merely called a ribbon) used in a thermal printer. Ink of each color of black (K), cyan (C), magenta (M) and yellow (Y) is cyclically applied to the ribbon as shown in FIG. 11. "K1, C1, M1 and Y1" respectively shown in FIG. 11 show the configuration composed of four colors per image plane of a printing cycle and next, K2, C2, - - - in a second printing cycle continue.

A black mark located in an ink-free area immediately before the start of each color is provided to identify color. Three bits are used in FIG. 11, for example, K is defined as 1, 0, 0 from the top, C is defined as 1, 1, 0, M is defined as 0, 0, 1 and Y is defined as 1, 0, 1. The above color identification mark is read by a photocoupler composed of a pair of a light emitting diode and a phototransistor arranged opposite with the ribbon between them and respectively not shown so as to inform the CPU, not shown in the printer what the next color is.

Figure 2:
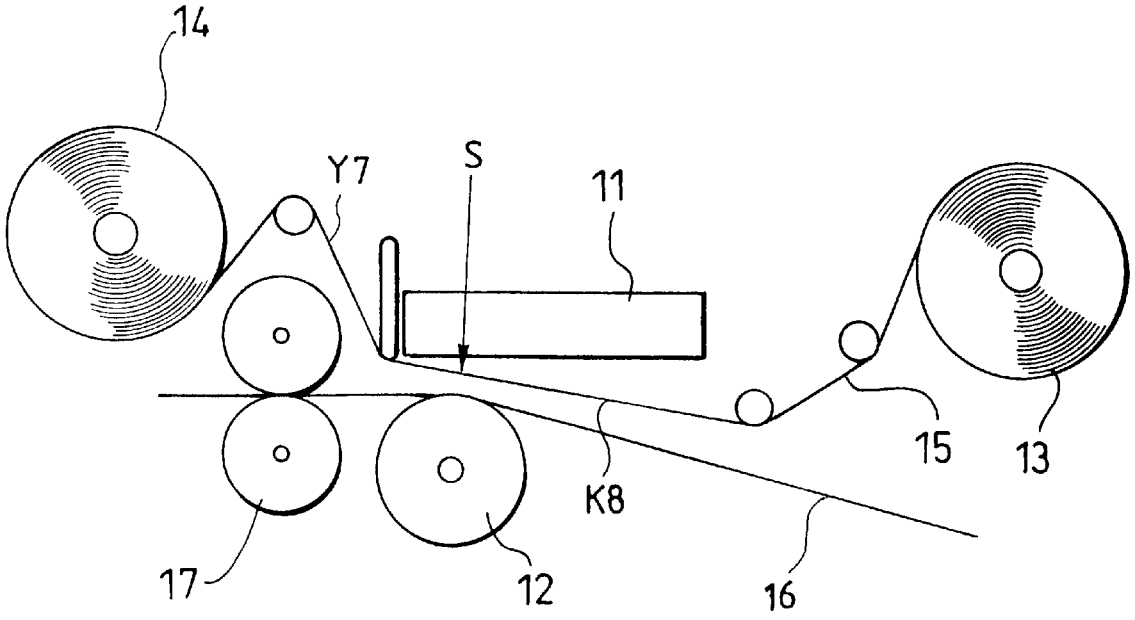
FIG. 2 is a front view showing a state of the ribbon when printing is finished in the thermal printer.
Figure 3:
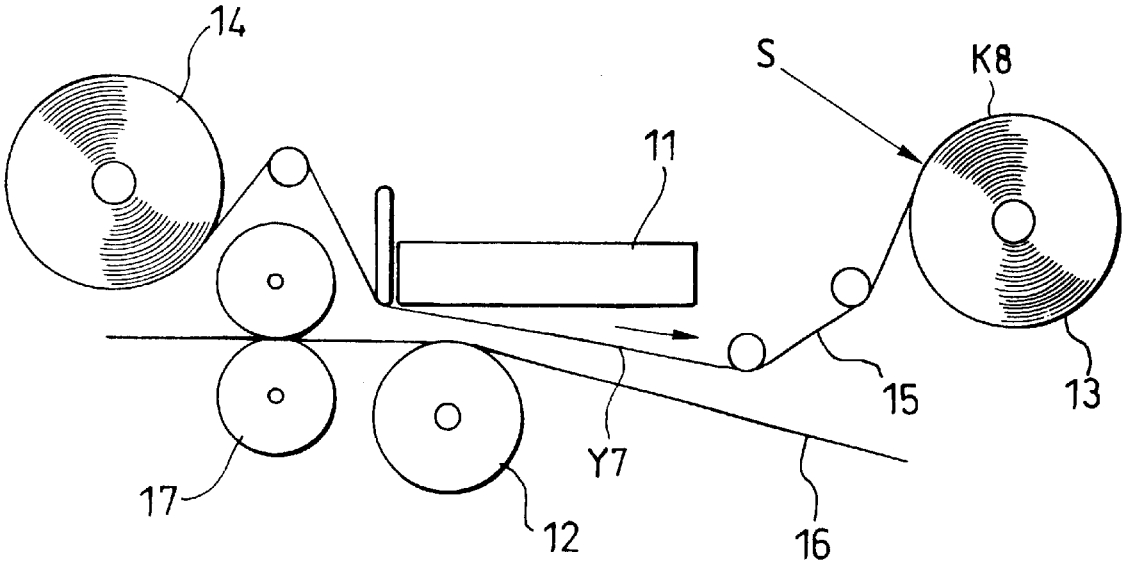
FIG. 3 is a showing a state of the ribbon when the thermal printer is ready for printing and equivalent to an embodiment of the present invention in the thermal printer.
Figure 4:
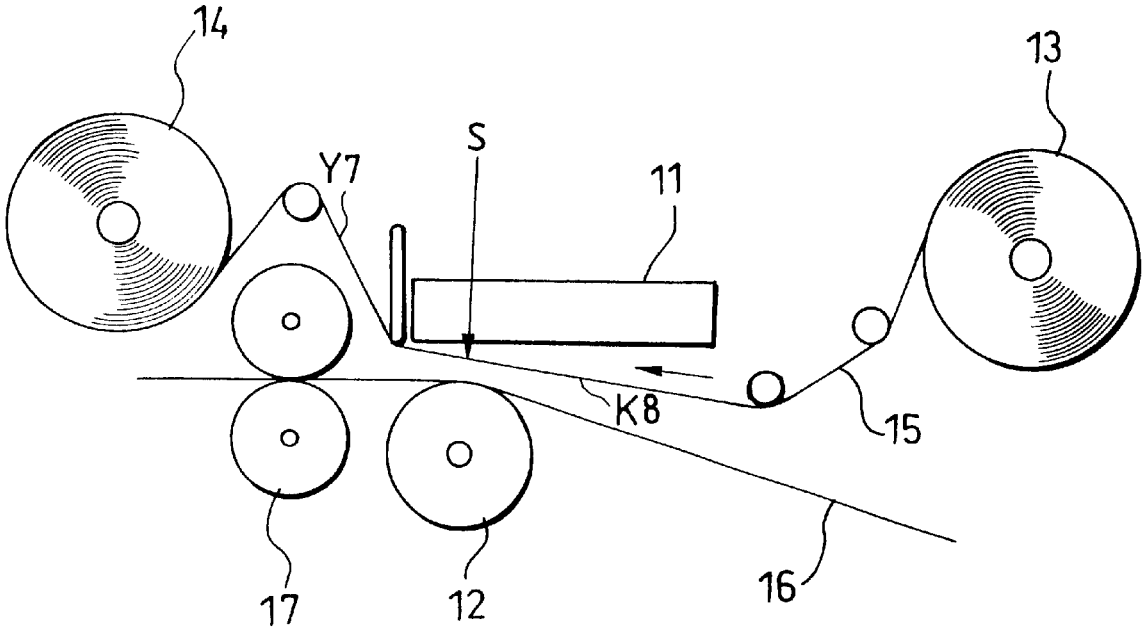
FIG. 4 is a front view showing a state of the ribbon when printing is restarted.

FIGS. 1 to 4 explain an embodiment of the present invention and FIG. 1 is a plan showing the movement of the ribbon 15 in the thermal printer. FIG. 1(*a*) shows a state of the ribbon when printing is finished, FIG. 1(*b*) shows a state of the ribbon on standby till next printing, FIG. 1(*c*) shows a state of the ribbon when the next printing is started. A dotted rectangle shows the position of a recording head. FIGS. 2 to 4 are front views showing the movement of the ribbon together with the main part of the thermal printer. FIG. 2 shows a state when printing is finished corresponding to FIG. 1(*a*), FIG. 3. shows a state of the ribbon on standby till next printing corresponding to FIG. 1(*b*) and FIG. 4 shows a state of the ribbon when the next printing is started corresponding to FIG. 1(*c*).

As shown in FIGS. 2 to 4, a reference number 11 denotes the thermal head, 12 denotes a platen, 15 denotes the ribbon, 13 denotes a part for supplying the ribbon 15, 14 denotes a part for winding the ribbon 15, 16 denotes an image receiving sheet and 17 denotes a capstan roller. An arrow S shows a position in which next printing is started of the ribbon, that is, the head of the ribbon (the end of K8 in FIG. 1).

The summary of the operation of the thermal printer composed as described above is as follows. As shown in FIG. 2, an image receiving sheet, 16 supplied from a supply port not shown and the ribbon 15 supplied from the supply part 13 are overlapped with the image receiving face of the image receiving sheet 16 and the ink face of the ribbon 15 opposite (in FIG. 2, the ribbon is separated from the image receiving sheet 16, however, actually the ribbon and the image receiving sheet are overlapped under the thermal head 11), are carried between the thermal head 11 and the platen 12 and while the ribbon 15 and the image receiving sheet 16 are carried between them, first, the thermal transfer of K is applied on the image receiving sheet 16 by the thermal printer 11 driven based upon predetermined image data. When the thermal transfer of K is finished, the ribbon 15 is peeled from the image receiving sheet 16 by a peeling bar and is wound by the winding part 14 by the length of K. In the meantime, the image receiving sheet 16 is carried in a reverse direction, the end is overlapped with the end of next ink C of the ribbon 15 in a state in which they are positioned and the thermal transfer of next C is applied on the image receiving sheet 16 based upon predetermined image data, the ribbon and the image receiving sheet being again carried between the thermal head 11 and the platen 12.

Similarly, the thermal transfer of M and Y is also applied on the image receiving sheet 16. After the thermal transfer of each color of K, C, M, Y is finished as described above, the image receiving sheet 16 is peeled from the ribbon 15 by the peeling bar and is carried to an output port not shown via the capstan roller 17. The ribbon 15 is wound in the ribbon winding part 14 by the quantity equivalent to one printing of K, C, M and Y.

Figure 9:
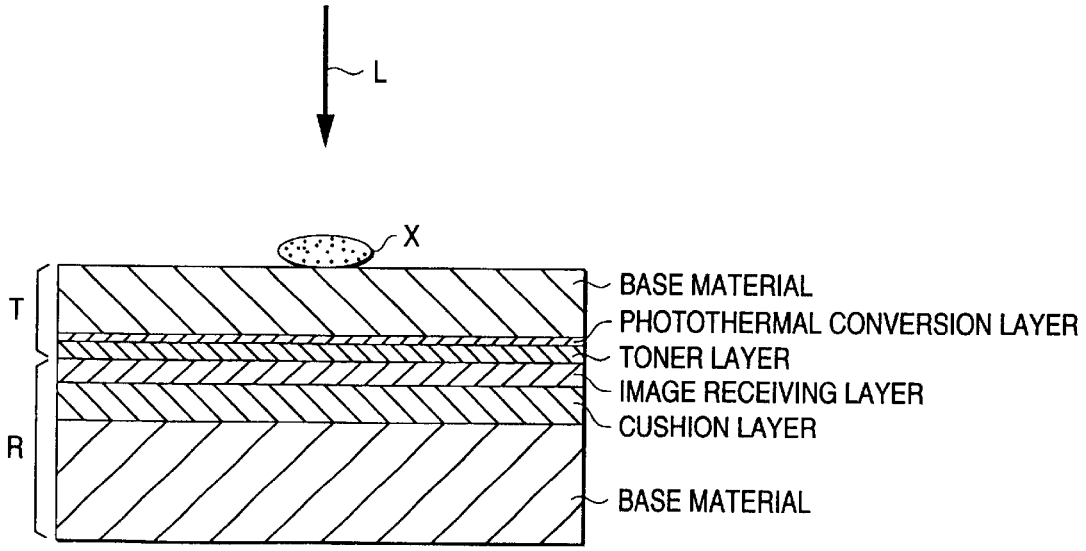
FIG. 9 explains a problem caused by dust in a laser printer.
Figure 10:
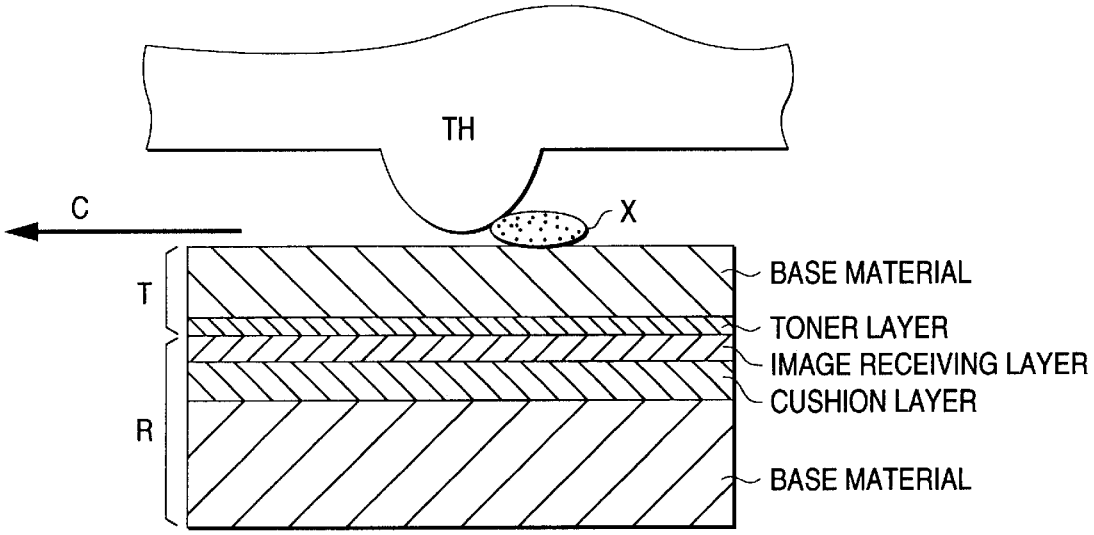
FIG. 10 explains a problem caused by dust in the thermal printer.

As described above, in a conventional type thermal printer, as for the position of the ribbon 15 when the last printing is finished, the end of K8 showing a position in which next printing is started comes immediately before the thermal head 11 as shown in FIG. 1(*a*) and waits for the next printing. However, if the ribbon 15 is left alone in the above position till next printing, dust adheres on the ink K8 of the ribbon 15 on standby, when the ribbon is set or when a cover is opened or closed and the trouble of an image such as a white dot and a white stripe described in relation to FIGS. 9 and 10 is caused.

In the thermal printer equivalent to this embodiment, the ink ribbon is automatically rewound by predetermined length immediately after the last printing is finished.

1) That is, as shown in FIGS. 1(*a*) and 2 respectively showing a state of the ribbon 15 when printing is finished, when the thermal transfer of ink M7 and ink Y7 is finished, the end of ink K8 which is a start position S in next printing comes immediately before the head 11.
2) In the present invention, as shown in FIGS. 1(*b*) and 3, the ribbon 15 is rewound in a direction shown by an arrow by quantity equivalent to approximately one image plane, ink Y7 the thermal transfer of which is already finished is located under the head 11 and the end of ink K8 which is the start position S in next printing is ready in a state in which the end is returned to the vicinity of the ribbon supply part 13. Therefore, even if dust accumulates on the ink Y7, no dust accumulates on the ink K8 in the next printing.
3) When next printing is started, the ribbon 15 is let out in a direction shown by an arrow by the quantity formerly rewound as shown in FIGS. 1(*c*) and 4, the ink Y7 on which dust accumulates is wound, the end of the ink K8 which is the start position S in the next printing and is rewound to the vicinity of the ribbon supply part 13 comes under the head. The above state is close to the state shown in FIG. 1(*a*).

Figure 5:
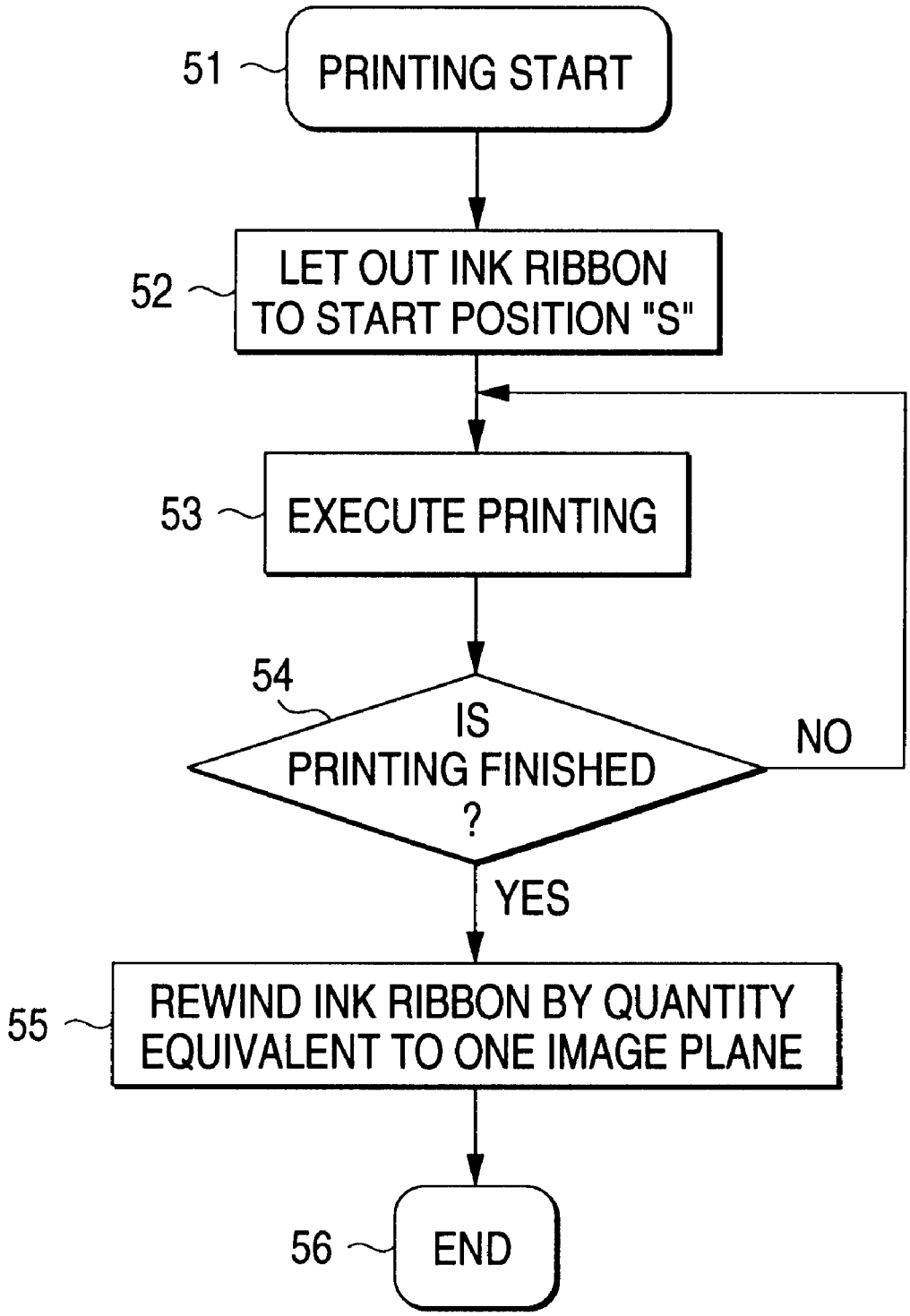
FIG. 5 explains the flow of operation equivalent to the first embodiment to the present invention shown in FIG. 1(*a*)–1(*c*).

FIG. 5 explains the flow of operation equivalent to the first embodiment of the present invention. First, when printing is started in 51, the ink ribbon is let out by a quantity formerly rewound in 52 prior to the execution of the printing 53 and the start position S is shifted to a recording position of the thermal head and a laser head. Afterward, the printing is executed in 53. When the printing is terminated in 54, the ink ribbon is rewound by quantity equivalent to approximately one image plane in 55 before termination in 56 and afterward, the above processing is terminated in 56.

Hereby, in the thermal printer in this embodiment, a part to be used next of the ribbon 15 is kept in a state in which the part is wound in the supply part 13 of the ribbon 15, dust never accumulates on the ribbon 15 and effect that the above unevenness of an image caused by the adhesion of dust and others can be prevented is acquired.

Next, another embodiment of the present invention will be described referring to FIGS. 6 and 7.

The configuration of a thermal printer in this embodiment is the same as that of the thermal printer in the above embodiment shown in FIGS. 2 to 4. The thermal printer in this embodiment is different from the thermal printer in the above embodiment in that in the above embodiment, the thermal printer gets ready after printing is finished, while in this embodiment, the thermal printer gets ready after ribbons are replaced.

Heretofore, when a ribbon holder is housed in a printer and the cover of the printer is closed after the cover of a thermal printer (as a recording head is fixed on the back side of the cover and the recording head is also lifted by opening the cover, the ink ribbon located under the recording head can be readily taken out) is opened to replace ribbons, the ribbon holder installed on the side of the cover of the thermal printer is detached, the old ribbon is taken out from the ribbon holder and a new one is set in the ribbon holder, the recording head is moved over the ribbon 15 by closing the cover of the printer. When the above movement operation is finished, the end of K8 of the ribbon 15 which is a printing start position comes under the thermal head 11 and the thermal printer gets ready for printing. However, if the ribbon 15 is left in the above condition till next printing, dust adheres on ink K1 of the ribbon 15 for the same reason as that described in relation to the above embodiment and the impairment of an image described in relation to FIGS. 9 and 10 such as a white dot and a white stripe is caused.

In the thermal printer in this embodiment, an ink ribbon is automatically rewound by predetermined length immediately after the setting of a new ribbon is finished.

Figure 6:
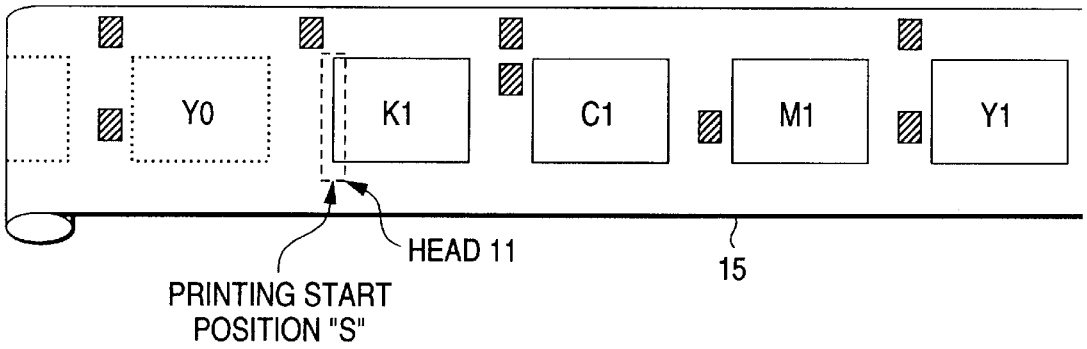
FIGS. 6(*a*)–6(*c*) are plans showing the movement of a ribbon equivalent to a second embodiment the present invention in a thermal printer.
Figure 6:
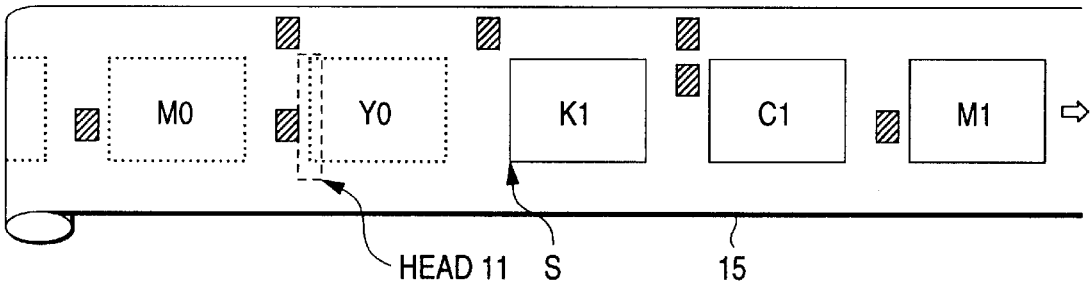
Figure 6:
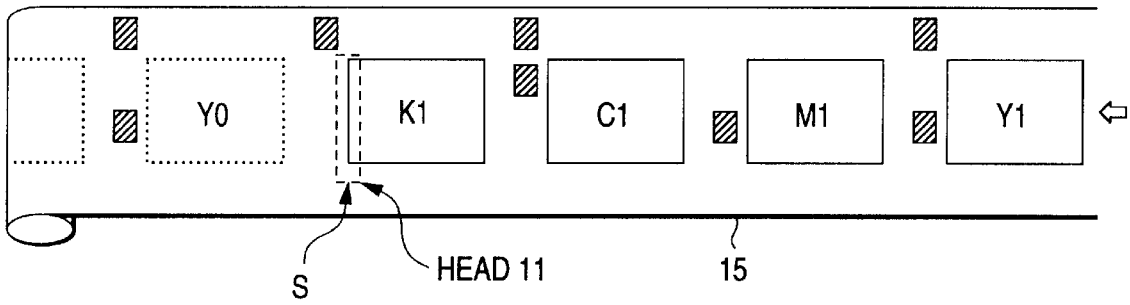

1) That is, as shown in FIG. 6(*a*) showing a state of the ribbon when the setting of the new ribbon 15 is finished, the end of ink K1 which is the start position S in printing comes immediately before a head 11.
2) In the present invention, as shown in FIG. 6(*b*), the ribbon 15 is rewound in a direction shown by an arrow by quantity equivalent to approximately one image plane, unused ink precedent to ink K1 or a part in which ink is not applied Y0 is located under the head 11 and the end of the ink K1 which is the start position S in next printing is kept in a state in which the end is returned to the ribbon supply part. Therefore, even if dust accumulates on Y0, no dust accumulates on the ink K1.
3) When printing is started, the ribbon 15 is let out in a direction shown by an arrow as shown in FIG. 6(*c*) by a quantity formerly rewound, Y0 on which dust accumulates is wound and the end of the ink K1 which is the start position S in next printing and is returned to the ribbon supply part comes under the head. The above state is close to the state shown in FIG. 6(*a*).

Figure 7:
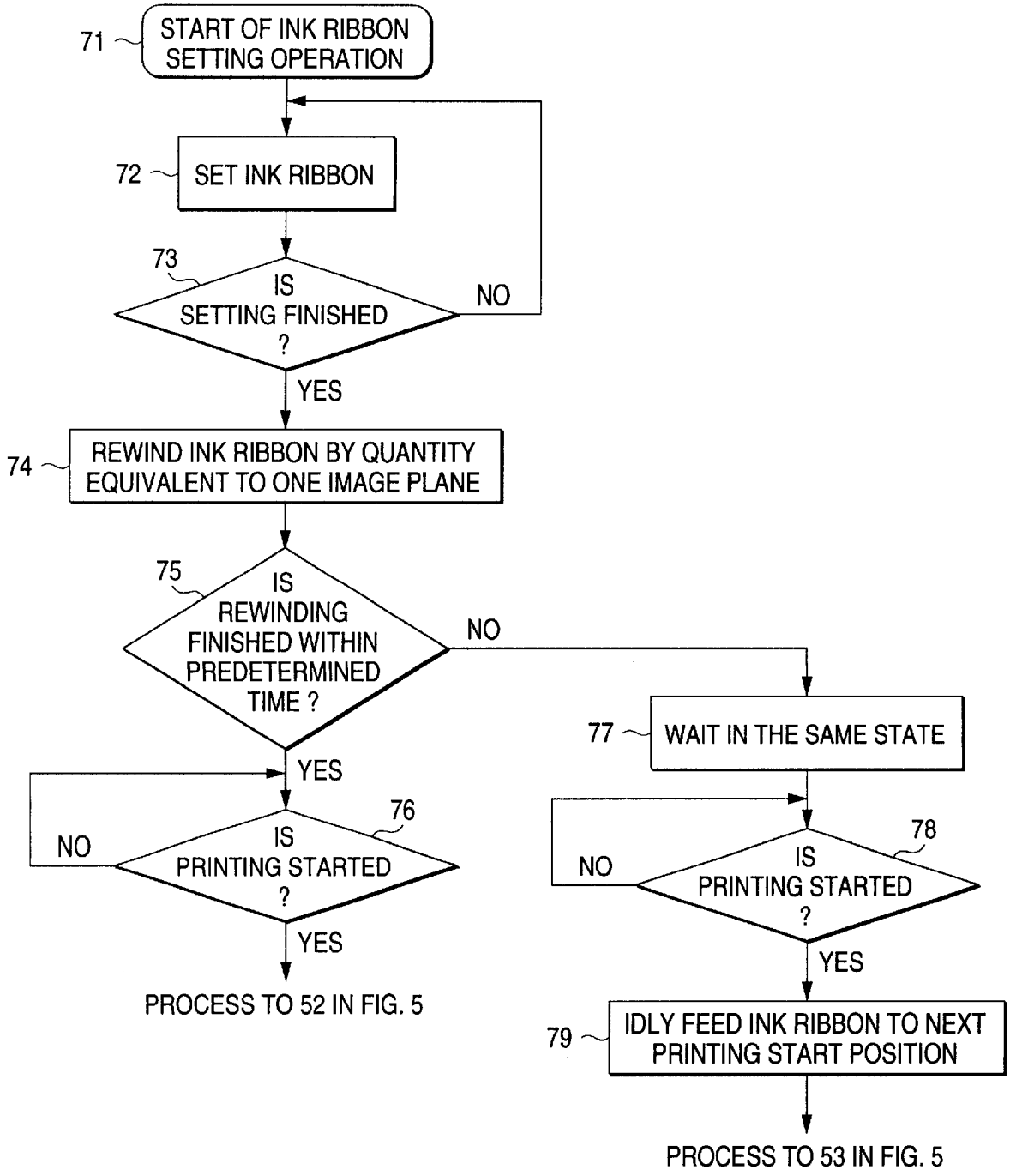
FIG. 7 explains the flow of operation equivalent to the second embodiment of the present invention shown in FIGS. 6(*a*)–6(*c*)

FIG. 7 explains the flow of operation equivalent to the second embodiment of the present invention. First, when the cover of a thermal printer is opened to replace ribbons in 71 and a ribbon holder installed on the side of the cover of the thermal printer is detached from the thermal printer, a sensor is operated and ribbon setting operation monitoring flow is started.

It is judged in 72 that the setting operation is not finished until the sensor senses the operation of closing the cover. When the ribbon holder is attached to the printer and the cover of the printer is closed after the old ribbon is taken out of the ribbon holder and a new ribbon is set, the sensor is operated and the termination of the setting is verified in 73. Then, if the ribbon is rewound by a quantity equivalent to approximately one image plane in 74 and the time required for rewinding at that time is within a predetermined time required for rewinding in 75, the thermal printer gets ready for the next printing start signal in 76. After processing jumps to 52 in the flow shown in FIG. 5 and the start position of the ink ribbon is let out under a recording head when a printing start signal comes, the thermal printer executes printing.

As described above, in the thermal printer in this embodiment, after the new ribbon is set, K1 to be used of the ribbon 15 is also kept wound in the supply part 13 of the ribbon 15 and the effect that dust never accumulates on K1 and the above unevenness of an image and others caused by the adhesion of dust can be prevented, is acquired.

The case that the set new ribbon 15 has room to rewind by a quantity equivalent to approximately one image plane in the end is described above. However, if an operator should forget to give the above room to the ribbon carelessly when the ribbon 15 is set, the above rewinding operation is disabled. A measure for solution in that case is equivalent to a third embodiment of the present invention.

That is, an ink ribbon is rewound in 75 in the flow shown in FIG. 7 to check whether there is room to rewind or not after the setting of the ink ribbon is finished and if the ink ribbon can be rewound, processing proceeds to 75 as described above. However, if the ink ribbon cannot be rewound (in the case of NO in 75), it is kept on standby as it is in 77. When first printing is started in 78, the ink ribbon is idly fed by the length within the length equivalent to one printing (the length equivalent to one printing of K, C, M, Y) in 79.

After the ink ribbon is idly fed, processing proceeds to 53 in the flow shown in FIG. 5 and printing is executed.

As described above, as in a thermal printer in the third embodiment, K1 to which dust may adhere in first printing of the ribbon 15 is not used and next K2 is used even if a new ribbon is set without room, the effect that the above unevenness of an image and others caused by the adhesion of dust can be prevented, is acquired.

Figure 8:
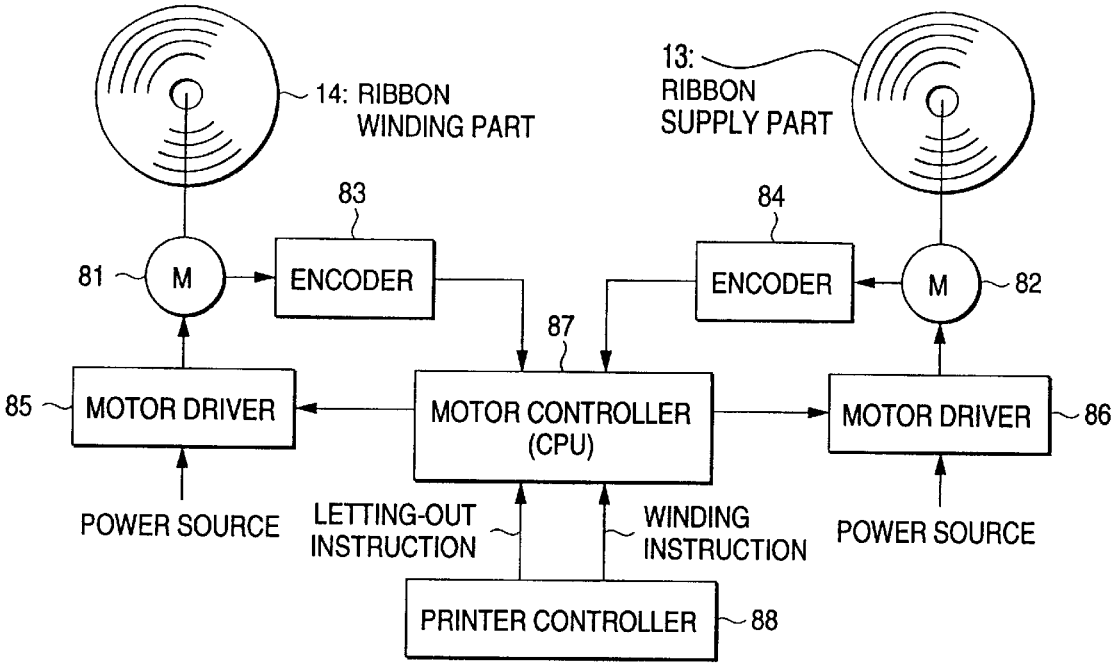
FIG. 8 is block diagram for explaining operation for moving the ink ribbon to a part to which the ribbon is supplied and a part for winding the ribbon by predetermined length.

FIG. 8 is a block diagram for explaining automatic rewinding means for automatically rewinding the above ink ribbon according to the present invention to a ribbon supply part by a predetermined length and automatic letting-out means for automatically letting out the ink ribbon to a ribbon winding part by a predetermined length. As shown in FIG. 8, a reference number 14 denotes the ribbon winding part, 13 denotes the ribbon supply part, the ribbon winding part and the ribbon supply part are respectively provided with a motor for driving 81 or 82, an encoder for detecting the rotational frequency of the motor 83 or 84, and a motor driver 85 or 86 for driving the motor, provided with a common motor controller 87 using a CPU to control each motor. An ink ribbon letting-out instruction and an ink ribbon winding instruction respectively from a printer controller 88 are input to the motor controller 87, the information of the rotational frequency of each motor from the encoders 83 and 84 is also input to the motor controller 87, the operation of how many times each motor is to be rotated is executed based upon the information and a control command is output to each motor driver 85 or 86. The motor drivers 85 and 86 respectively drive the motors 81 and 82 according to each control command.

For example, if the ink ribbon is required to be rewound by a quantity equivalent to one image plane, an instruction for rewinding by a quantity equivalent to one image plane is sent from the printer controller 88 to the motor controller 87, the motor controller 87 operates how many times the motor 82 is to be rotated to rewind by a quantity equivalent to one image plane, sends a control command to the motor driver 86 and the motor driver 86 drives the motor 82 according to the control command. When it is known from a signal of the rotational frequency from the encoder 84 that the rotational frequency of the motor 82 reaches a predetermined rotational frequency, the motor controller 87 issues a stop signal to the motor driver 86 and rewinding operation is finished.

The letting out operation is also similar.

It need scarcely be said that the above embodiments each show an example of the present invention and the present invention should be not limited to these.

For example, the unit of one image plane is used for the rewound length of the ribbon. However, if a distance between the recording head and the ribbon supply part is longer than one image plane or depending upon the configuration of the ribbon, two image planes or longer may be rewound.

The example of the thermal printer is described above, however, the present invention can be applied to any printer which adopts a method of transferring using an ink ribbon and depends upon energy except heat. For example, a liquid crystal display printer, a liquid emitting diode printer and a laser disc printer respectively utilizing electrotransfer, the hardening of a photopolymer and others, can be given.

As described above in detail, according to the present invention, as a part to be used for next printing of the ink ribbon is rewound in a direction of the ribbon supply part to prevent dust from adhering to the above part after setting the ink ribbon and/or every termination of a current printing, the adhesion itself of dust can be prevented and as a location in which dust may adhere is idly fed and is not used, a remarkable effect that a beautiful thermal transfer print free of a void and the unevenness of an image is produced.

What is claimed is:

1. A method of preventing dust from adhering to an ink ribbon of a printer in the printer for generating an image on a recording material using the ink ribbon, said ink ribbon including a plurality of different colored inks applied thereon in a cyclical arrangement, said method comprising the steps of:

setting said ink ribbon into a ribbon holder of a printer;

performing printing by transferring the image onto the recording material;

rewinding automatically said ink ribbon by a predetermined length immediately after printing is completed;

waiting in standby mode until a next printing is authorized; and letting out said ink ribbon by a quantity equal to said predetermined length and starting said next printing.

2. The method of preventing dust from adhering to an ink ribbon of a printer according to claim 1, wherein if said ink ribbon is a new ink ribbon, the step of closing a cover of the printer immediately after the setting step, activates the rewinding step.

3. The method of preventing dust from adhering to an ink ribbon of a printer according to claim 1, wherein said predetermined length is equivalent to one image plane.

4. A method of preventing dust from adhering to an ink ribbon of a printer in the printer for generating an image on a recording material using the ink ribbon, said ink ribbon including a plurality of different colored inks applied thereon in a cyclical arrangement, said method comprising the steps of:

setting said ink ribbon into a ribbon holder of a printer;

performing printing by transferring the image onto the recording material;

rewinding automatically said ink ribbon by a predetermined length after printing is completed;

waiting in standby mode until a next printing is authorized; and letting out said ink ribbon by a quantity equal to said predetermined length and starting said next printing;

wherein, if said ink ribbon is a new ink ribbon, the step of closing a cover of the printer immediately after the setting step, activates the rewinding step; and wherein, if either one of a) said rewinding step cannot take place due to said new ink ribbon not having any room to be rewound, and b) said rewinding step is not performed within a predetermined time, the steps of keeping said new ink ribbon in standby, and idly feeding said new ink ribbon by a length equal to a length of one printing, are performed prior to the printing step.

5. A printer for generating an image on a recording material, comprising:

an ink ribbon installed in a ribbon holder in said printer;

means for automatically rewinding said ink ribbon by a predetermined length immediately after termination of current printing;

means for holding said printer with said rewound ink ribbon in standby until a next print command is given; and means for letting out said ink ribbon by said predetermined length after said next print command is given and prior to said next printing.

6. The printer for generating an image on a recording material according to claim 5, further comprising a sensing mechanism which senses an operation of closing a cover of a printer in order to activate said automatic rewinding means to start rewinding said ink ribbon.

7. The printer for generating an image on a recording material according to claim 6, wherein said image is a color image.

8. The printer for generating an image on a recording material according to claim 5, wherein said predetermined length is equivalent to one image plane.

9. A printer for generating an image on a recording material, comprising:

an ink ribbon installed in a ribbon holder in said printer;

means for automatically rewinding said ink ribbon by a predetermined length after termination of current printing;

means for holding said printer with said rewound ink ribbon in standby until a next print command is given;

means for letting out said ink ribbon by said predetermined length after said next print command is given and prior to said next printing; and means for idly feeding said ink ribbon by a length equal to a length of one printing if either one of said rewinding means is temporarily disabled due to said ink ribbon not being able to be rewound, and if said rewinding means does not rewind said ink ribbon within a predetermined length of time.

10. A thermal printer for generating an image on a recording material, comprising:

an ink ribbon installed in a ribbon holder in said printer;

means for automatically rewinding said ink ribbon by a predetermined length immediately after termination of current printing;

means for holding said printer with said rewound ink ribbon in standby until a next print command is given; and means for letting out said ink ribbon by said predetermined length after said next print command is given and prior to said next printing.

11. A printer for generating an image on a recording material, comprising:

an ink ribbon installed in a ribbon holder in said printer, said ink ribbon including a plurality of different colored inks applied thereon in a cyclical arrangement; and means for automatically rewinding the ink ribbon by a predetermined length immediately after either one of setting the ink ribbon and termination of current printing for said plurality of different colored inks;

means for holding said printer with said rewound ink ribbon in standby until a next print command is given; and means for letting out said ink ribbon by said predetermined length after said next print command is given an d prior to said next printing.

* * * * *